US008794640B2

(12) United States Patent
Bergman et al.

(10) Patent No.: US 8,794,640 B2
(45) Date of Patent: Aug. 5, 2014

(54) TURBINE SEALING SYSTEM

(75) Inventors: Russell J. Bergman, Windsor, CT (US); James P. Chrisikos, Vernon, CT (US); Leonard A. Bach, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 980 days.

(21) Appl. No.: 12/731,285

(22) Filed: Mar. 25, 2010

(65) Prior Publication Data

US 2011/0233876 A1 Sep. 29, 2011

(51) Int. Cl.
*F16J 15/08* (2006.01)
*F01D 11/00* (2006.01)

(52) U.S. Cl.
CPC ..... *F01D 11/005* (2013.01); *F25D 2240/57* (2013.01)
USPC ..... 277/654; 277/652

(58) Field of Classification Search
USPC ..... 277/647, 650, 652–654
See application file for complete search history.

(56) References Cited

U.S. PATENT DOCUMENTS

| | | | | |
|---|---|---|---|---|
| 4,457,523 | A | 7/1984 | Halling et al. | |
| 5,215,435 | A * | 6/1993 | Webb et al. | 277/414 |
| 5,522,698 | A * | 6/1996 | Butler et al. | 415/170.1 |
| 5,738,490 | A | 4/1998 | Pizzi | |
| 5,762,472 | A | 6/1998 | Pizzi et al. | |
| 5,799,954 | A | 9/1998 | Layer | |
| 5,924,699 | A * | 7/1999 | Airey et al. | 277/411 |
| 5,988,975 | A | 11/1999 | Pizzi | |
| 6,076,835 | A * | 6/2000 | Ress et al. | 277/637 |
| 6,821,086 | B1 * | 11/2004 | Brisson et al. | 277/411 |
| 6,951,339 | B2 | 10/2005 | Turnquist et al. | |
| 7,207,771 | B2 | 4/2007 | Synnott et al. | |
| 7,217,089 | B2 | 5/2007 | Durocher et al. | |
| 7,600,967 | B2 | 10/2009 | Pezzetti, Jr. et al. | |
| 2006/0292001 | A1 | 12/2006 | Keller et al. | |
| 2011/0236199 | A1 * | 9/2011 | Bergman et al. | 415/208.1 |

* cited by examiner

*Primary Examiner* — Gilbert Lee
(74) *Attorney, Agent, or Firm* — Carlson, Gaskey & Olds, P.C.

(57) ABSTRACT

A sealing system for sealing a gap between a first body and a second body includes a first seal having a first portion adapted to be attached to the first body and a second portion extending into the gap. The sealing system also includes a second seal. The second seal has a first portion adapted to be attached to the second body and a second portion extending across the gap. The second portion of the first seal and the second portion of the second seal are adjacent and overlapping with each other to seal the gap.

30 Claims, 7 Drawing Sheets

TURBINE SEALING SYSTEM

BACKGROUND OF THE INVENTION

This disclosure relates generally to a gas turbine engine and more particularly to a gas turbine engine assembly that seals a gap between components thereof.

Components of a turbine engine may be used in conjunction to seal various components as part of a larger turbine engine system. For example, a Tangential On-Board Injector ("TOBI") is a well know device, which may be known by different names, that is utilized to provide cooling air to the turbine section of the gas turbine engine. The TOBI receives air from a source of cooling air and passes it to the rotating turbine. The efficient use of the cooling air by the TOBI is important to provide cooling capacity to the engine, and to enhance engine performance.

A TOBI may be used in conjunction with a group of turbine vanes. However, using these or similar components can create gaps between the components.

SUMMARY OF THE INVENTION

A sealing system for sealing a gap between a first body and a second body includes a first seal having a first portion adapted to be attached to the first body and a second portion extending into the gap. The sealing system also includes a second seal. The second seal has a first portion adapted to be attached to the second body and a second portion extending across the gap. The second portion of the first seal and the second portion of the second seal are adjacent and overlapping with each other to seal the gap.

A sealing system for sealing a gap between a first body and a second body includes a first seal having a first portion adapted to be attached to the first body and a second portion extending into the gap. The sealing system further includes a second seal. The second seal has a first portion adapted to be attached to the second body and a second portion extending into the gap. The second portion of the first seal and the second portion of the second seal are parallel and overlapping with each other to seal the gap.

These and other features of the present invention can be best understood from the following specification and drawings, the following of which is a brief description.

DETAILED DESCRIPTION OF THE PREFERRED EMBODIMENT

Figure 1:
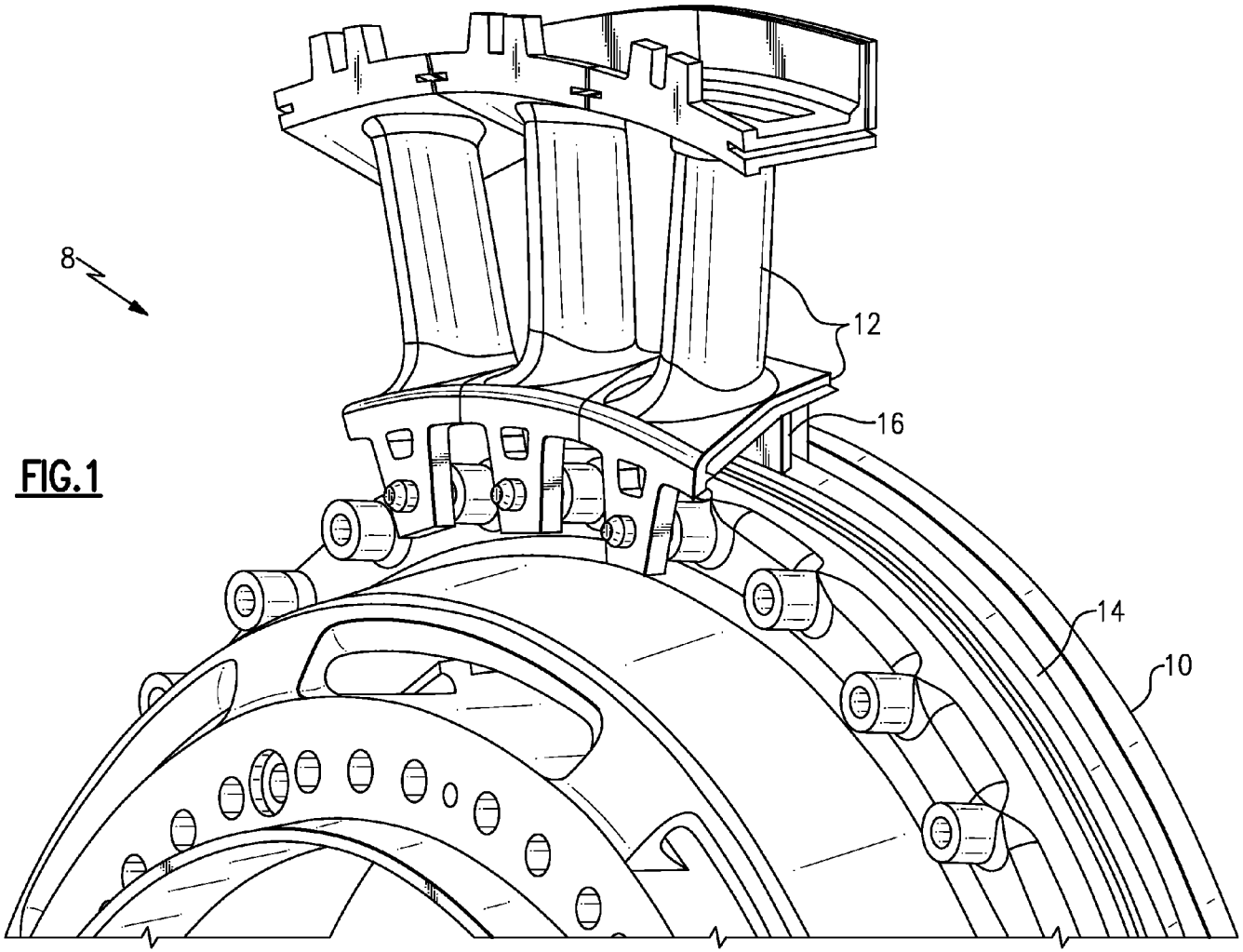
FIG. 1 shows a perspective view of the sealing system.

Referring to FIG. 1, a sealing system 8 is shown. The sealing system 8 is located within a turbine engine, downstream of a compressor (not shown), and includes a first body

10, a second body 12, a first seal 14, and a second seal 16. As seen in FIG. 1, the first body 10 is continuous and the second body 12 is segmented such that the segments are joined to form a singular body. Alternatively, the first body 10 may be segmented and the second body 12 may be continuous, or both the first body 10 and second body 12 can be segmented. While not limiting, as shown in FIG. 1, the first body 10 is a TOBI and the second body 12 is a ring of turbine vanes.

The first body 10 includes a first seal 14, and the second body 12 includes a second seal 16. While not limiting, the seals 14, 16 can be made of a material such as AMS 5608 Cobalt, or similar material. Similarly, the first body 10 and second body 12 may be cylinders, such as a TOBI or ring of turbine vanes, and may be continuous or segmented.

The first seal 14, as shown, is a ring seal. The second seal 16, as shown, is a featherseal. Both the first seal 14 and second seal 16 are not limited to these types of seals, but are able to account for relative movement between the bodies caused by heating and cooling thereof. The seals 14, 16 may also expand at different rates relative to each other to account for differing thermal transients. The first seal 14, as shown in FIG. 1, has a smaller diameter than the first body 10 and sits within the first body 10. The first seal 14 is inserted by slightly contracting, or otherwise forcing the seal 14 such that it will fit onto the first body 10. It is, at least in part, held in place within the first body 10 by slight interference loading between the first body 10 and the first seal 14, causing it to create a seal with the contacting portion of the first body 10. The interference loading occurs from contact between the first seal 14 and first body 10. Both the first seal 14 and second seal 16 may be removable to allow for a replacement seals 14, 16 when necessary.

Figure 2:
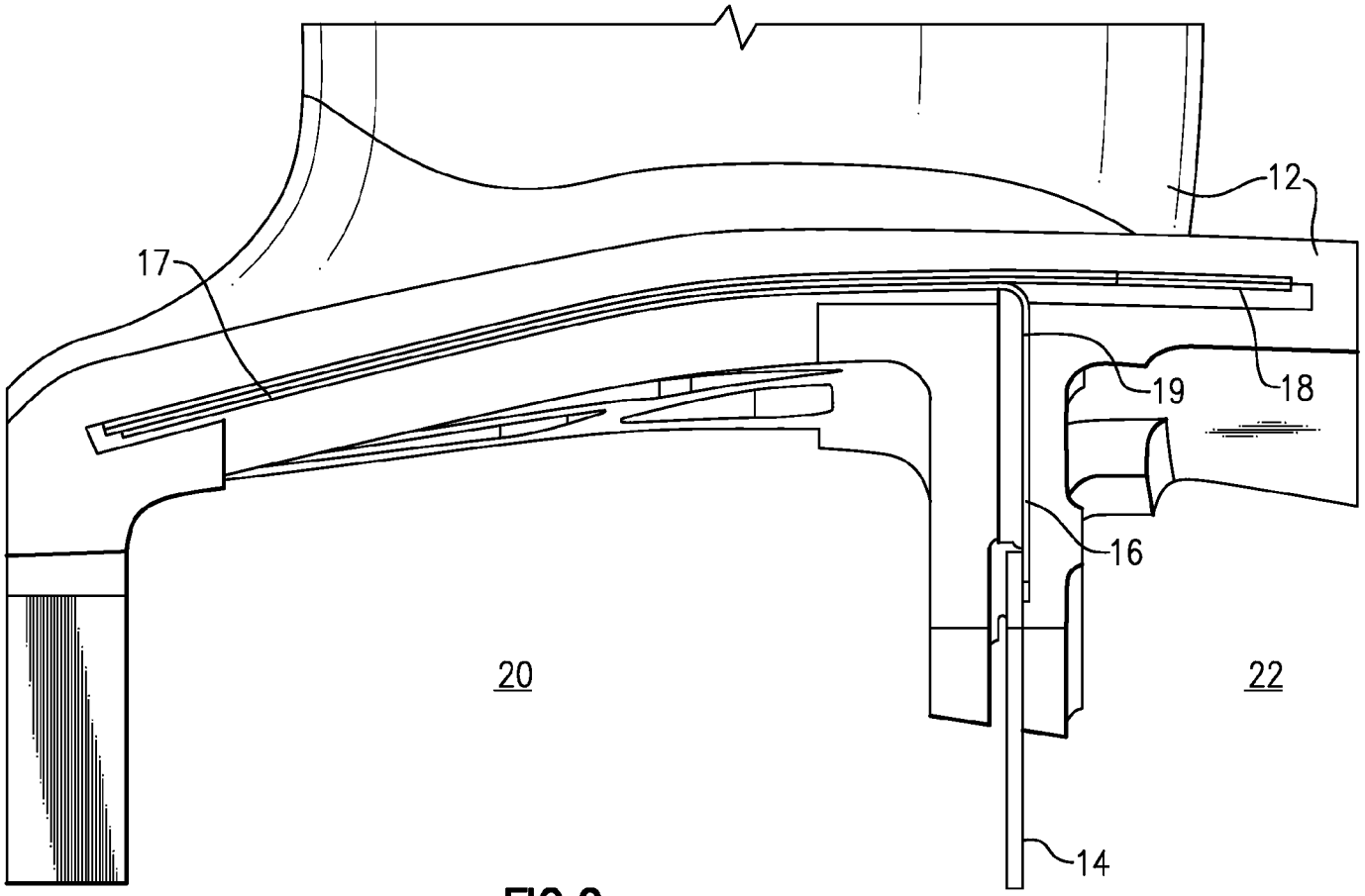
FIG. 2 shows a cross section of the sealing system, including both a first and second seal.

Referring to FIG. 2, the second seal 16 sits within the second body 12. The second seal 16 is used to seal circumstantial gaps between adjacent second bodies 12. The second seal 16 is bent such that it is able to occupy both a vertical and horizontal position within the second body 12. The second seal 16 is inserted into the second body 12 and shaped such that a second section 19 extends in a generally vertical direction relative to a third seal 18, which extends in a relatively horizontal direction. The angle between the first section 17 and the third seal 18 is sufficient that the second seal 16 cannot escape out of the slot retaining the first seal 14. In one non-limiting example, the second seal is 16 a featherseal and includes a bend of about 90°. Pressure within the second body 12 from a pressure differential between the high pressure area 20 and the low pressure area 22 pushes the seal 16 in an upward direction at section 17, and in conjunction with third seal 18 back against the outer wall relative to a high pressure side 20. This forces the second seal 16 against the second body 12. The second seal 16 is inserted into the second body 12 without further means of connection to the second body 12.

Figure 3:
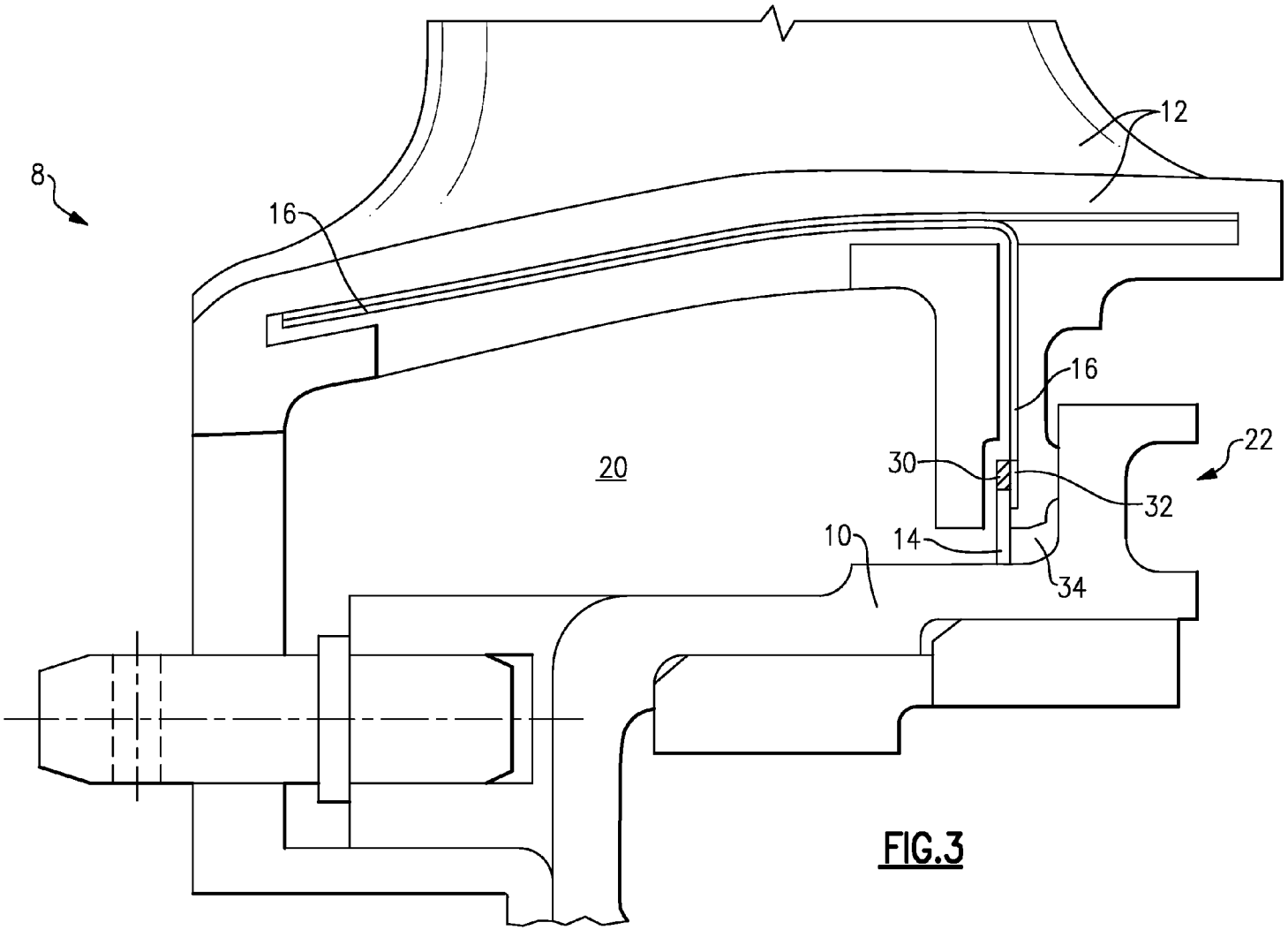
FIG. 3 shows a perspective view of the sealing system, including a first and second body.

Referring to FIG. 3, there is a gap 34, which exists between the first body 10 and second body 12 and allows cooling air from the high pressure side 20 to escape the system 8. At least a first portion 30 of the first seal 14 and a first portion 32 of the second seal 16 are aligned parallel to one another and are overlapping vertically within the gap 34. The first seal 14 and second seal 16 are aligned to seal the gap 34, as well as effectively limiting any gaps 34 at the first portion 30 of the first seal 14 and the first portion 32 of the second seal 16. By sealing the gap 34, air used by the system 8 and found in the high pressure side 20 is prevented from leaving the system 8, as it can no longer escape through the gap 34. The first seal 14 and second seal 16 are held in a relatively fixed position and pushed together because of the pressure differential existing between a high pressure side 20 and a low pressure side 22. The pressure differential causes the seals 14,16 to move together to reduce any amount of significant gaps between the seals 14,16 as well as to seal the gap 34. Higher pressure air comes from the air compressor discharge (not shown) from a turbine engine to create the high pressure side 20.

Figure 4:
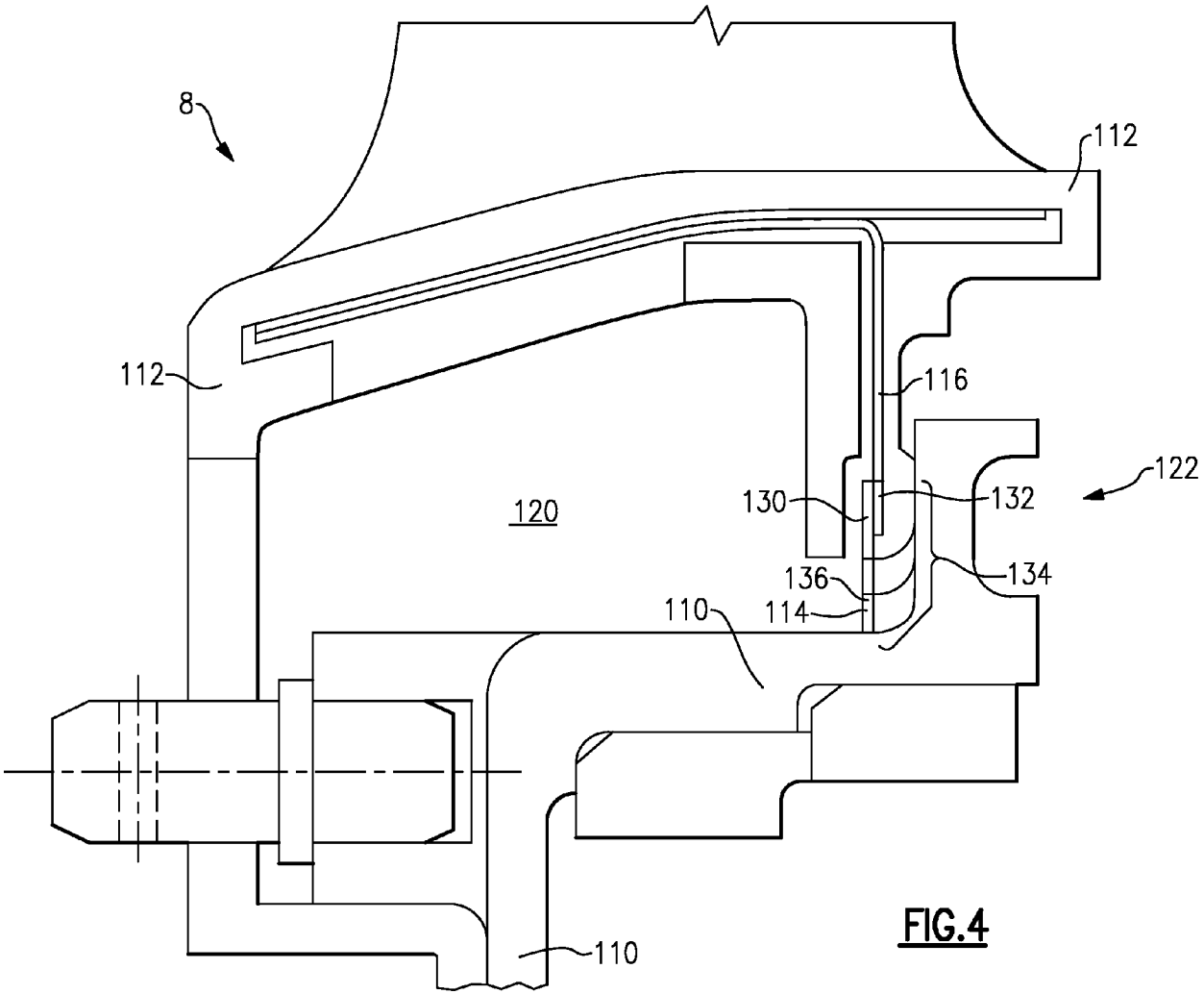
FIG. 4 shows a cross section of the sealing system using a step configuration.

Referring to FIG. 4, a sealing system 8 includes a first body 110 and second body 112. A first seal 114 and second seal 116 are further included, with the first seal 114 contacting the first body 110 and a second seal 116 contacting the second body 112. There is also a gap 134, which exists between the first body 110 and second body 112, that allows cooling air from the high pressure side 120 to escape the system 8. A first portion 130 of the first seal 114 is parallel to and overlapping a first portion 132 of the second seal 116. A second portion 136 of the first seal 114 is also shown. The gap 134 is sealed such that at least a portion of the gap 134 is located between the first portion 130 and second portion 136 of the first seal 114. By sealing the gap 134, air used by the system 8 and found in the high pressure side 120 is prevented from leaving the system 8, as it can no longer escape through the gap 134. The first seal 114 and second seal 116 are held in a relatively fixed position and pushed together because of the pressure differential existing between a high pressure side 120 and a low pressure side 122. The pressure differential causes the seals 114, 116 to move together to reduce any amount of significant gaps between the seals 114, 116 as well as to seal the gap 134. Higher pressure air comes from the air compressor discharge (not shown) from a turbine engine to create the high pressure side 120.

Figure 5:
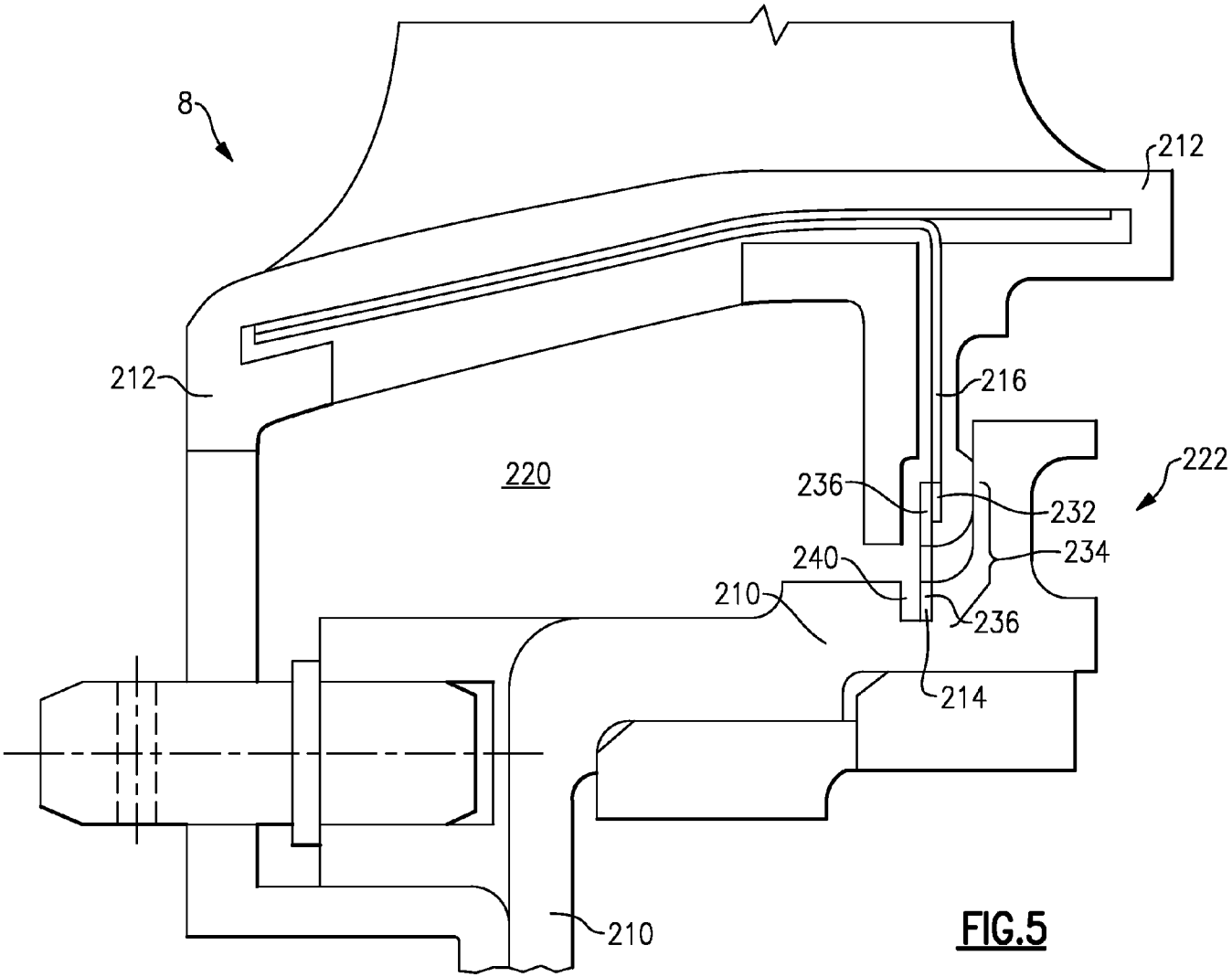
FIG. 5 shows a cross section of the sealing system using a slot configuration.

Referring to FIG. 5, a sealing system 8 includes a first body 210 and second body 212. A first seal 214 and second seal 216 are also shown, with the first seal 214 at least partially contacting the first body 210 and the second seal 216 at least partially contacting the second body 212. There is also a gap 234, which exists between the first body 210 and second body 212 and allows cooling air from the high pressure side 220 to escape the system 8. A first portion 230 of the first seal 214 is parallel to and overlapping a first portion 232 of the second seal 216. A second portion 236 of the first seal 214 is also shown. The second portion 236 sits within a slot 240 created within the first body 210. The gap 234 is sealed such that at least a portion of the gap 234 sits between the first portion 230 and second portion 236 of the first seal 214. By sealing the gap 234, air used by the system 8 and found in the high pressure side 220 is prevented from leaving the system 8, as it can no longer escape through the gap 234. The first seal 214 and second seal 216 are held in a relatively fixed position and pushed together because of the pressure differential existing between a high pressure side 220 and a low pressure side 222. The pressure differential causes the seals 214, 216 to move together to reduce any amount of significant gaps between the seals 214, 216 as well as to seal the gap 234. Higher pressure air comes from the air compressor discharge (not shown) from a turbine engine to create the high pressure side 220.

Figure 6:
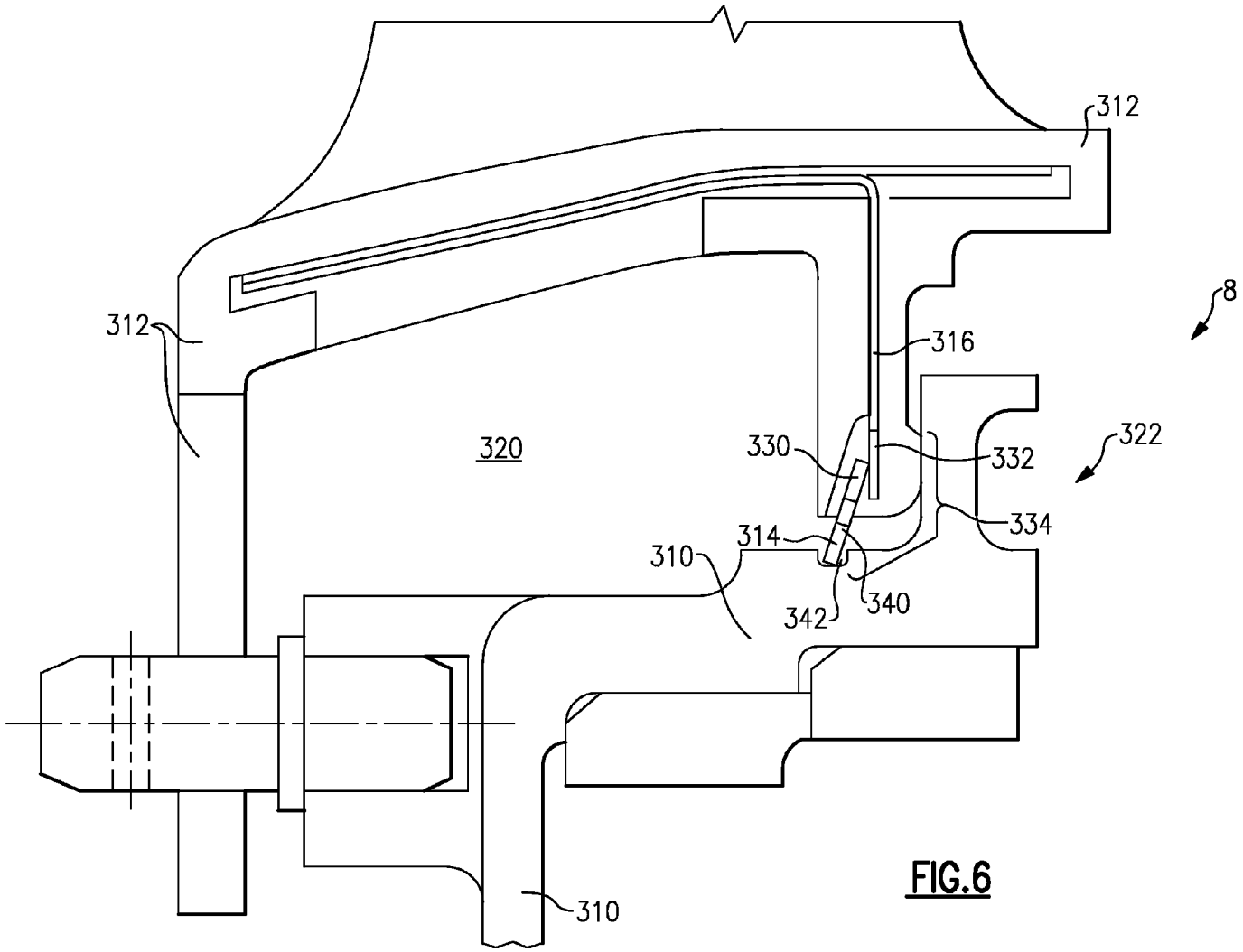
FIG. 6 shows a cross section of the sealing system using a slant configuration with a slot.
Figure 7:
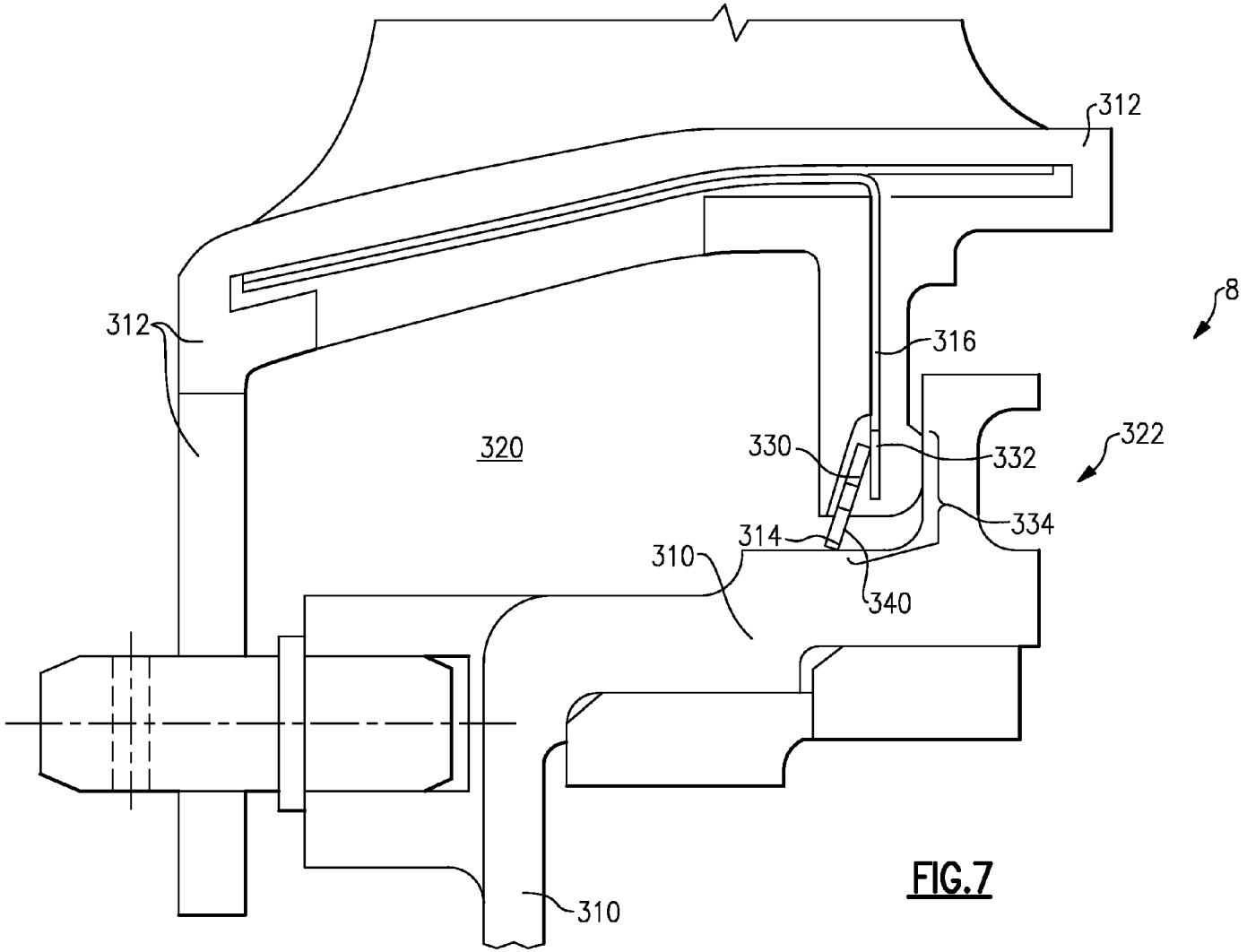
FIG. 7 shows a cross section of the sealing system using a slant configuration without a slot.

Referring to FIGS. 6 and 7, a sealing system 8 includes a first body 310 and second body 312. A first seal 314 is in contact with the first body 310, and a second seal 316 is in contact with the second body 312. Alternatively, a first section 330 of the first seal 314 can sit in a slot 342 of the first body 310. The first seal 314 may sit within a slot 342 of the first body 310. There is also a gap 334, which exists between the first body 310 and second body 312 and allows cooling air from the high pressure side 320 to escape the system 8. A first portion 330 of the first seal 314 is adjacent to a first portion 332 of the second seal 316. The first portion 330 of the first seal 314 and first portion 332 of the second seal 316 at least partially overlap relative to each other. The combination of the first seal 314 and second seal 316 seal the gap 334, preventing any cooling air present in the high pressure side 320 from flowing out of the system through the gap 34 towards a low pressure side 322. Alternatively, the gap 334 can sit between a second portion 340 and the first portion 330 of the first seal 314. The first seal 314 and second seal 316 are held in a relatively fixed position due to pressure as well as interference loading. Pressure results from the flow of air compressor discharge (not shown) from a turbine engine into a high pressure side 320. The pressure differential between the high pressure side 320 and the low pressure side 322 causes the seals 314, 316 to move together to reduce any amount of significant gaps between the seals 314, 316 as well as to seal the gap 334. Here, due to the angle of the first seal 314 within the system 8, the first seal 314 seals at the first body 310 more efficiently due to the increased pressure loading across the seal 314. This accounts for less of the first portion 330 of the first seal 314 being in registration with the first portion 332 of the second seal 316

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A sealing system for sealing a gap between a first body and a second body comprising:

a first seal having a first portion adapted to be attached to said first body and a second portion extending across said gap and a second seal having a first portion adapted to be attached to said second body and a second portion extending across said gap wherein said second portion of said first seal and said second portion of said second seal are adjacent and overlapping with each other to seal said gap, wherein said second seal includes a horizontal section, and a vertical section extending from said horizontal section, said horizontal section and said vertical section enclosed in said second body, wherein said first body includes a slot, wherein said first seal extends into said slot, wherein said first seal and said second seal are held in a fixed position by gas pressure.

2. The sealing system of claim 1, wherein one of the first body and the second body is continuous and the other of the first body and the second body is segmented.

3. The sealing system of claim 2, wherein the first body and the second body are cylinders.

4. The sealing system of claim 1, wherein both the first body and the second body are segmented.

5. The sealing system of claim 1, wherein the first portion of the first seal is within the slot of the first body, at least a part of the gap sealed by the section of the first seal between the first portion and second portion.

6. The sealing system of claim 1, wherein said first body and said second body define a high pressure side in fluid communication with the first seal, wherein said high pressure side and a low pressure side axially spaced from the high pressure side form a pressure differential adapted to hold said first seal and said second seal in a fixed position.

7. The sealing system of claim 1, wherein said first body is a Tangential On-Board Injector and said second body is a turbine vane.

8. The sealing system of claim 1, wherein said first seal and said second seal are removable.

9. The sealing system of claim 8, wherein said first seal is removable relative to said first body.

10. The sealing system of claim 1, wherein a third seal is disposed within said second body adjacent said second seal.

11. The sealing system of claim 1, wherein said second seal is only connected to said second body by a pressure differential between a high pressure area and a low pressure area that forces said second seal against said second body.

12. The sealing system of claim 1, wherein said first seal and said second seal have different rates of thermal expansion.

13. The sealing system of claim 1, wherein said second portion of first seal is not disposed in said slot.

14. A sealing system for sealing a gap between a first body and a second body comprising:

a first seal having a first portion adapted to be attached to said first body and a second portion extending across said gap and a second seal having a first portion adapted to be attached to said second body and a second portion extending across said gap wherein said second portion of said first seal and said second portion of said second seal are adjacent and overlapping with each other to seal said gap, wherein said second seal includes a horizontal section, and a vertical section extending from said horizontal section, said horizontal section and said vertical section enclosed in said second body, wherein said first body includes a slot, wherein said first seal extends into said slot, wherein the first seal is a ring seal and the second seal is a featherseal.

15. A sealing system for sealing a gap between a first body and a second body comprising:

a first seal having a first portion adapted to be attached to said first body and a second portion extending into said gap and a second seal having a first portion adapted to be attached to said second body and a second portion extending into said gap wherein said second portion of said first seal and said second portion of said second seal are parallel and overlapping with each other to seal said gap, wherein a third seal is disposed within said second body adjacent said second seal, wherein the first seal and second seal are held in a fixed position by as pressure.

16. The sealing system of claim 15, wherein the first seal is at least partially attached to the first body by interference loading.

17. The sealing system of claim 15, wherein the at least a portion of the gap is sealed by the section of the first seal between the first portion and second portion.

18. The sealing system of claim 17, wherein the first seal sits in a slot of the first body.

19. The sealing system of claim 15, wherein one of the first body and the second body is continuous and the other of the first body and the second body is segmented.

20. The sealing system of claim 19, wherein the first body and the second body are cylinders.

21. The sealing system of claim 20, wherein the first body and the second body are concentric.

22. The sealing system of claim 15, wherein both the first body and the second body are segmented.

23. The sealing system of claim 15, wherein the first seal and second seal are held in a fixed position by gas pressure.

24. The sealing system of claim 15, wherein the first seal and second seal are made of AMS 5608 Cobalt.

25. The sealing system of claim 15, wherein the first seal is removable relative to the first body.

26. A sealing system for sealing a gap between a first body and a second body comprising:

a first seal having a first portion adapted to be attached to said first body and a second portion extending into said gap and a second seal having a first portion adapted to be attached to said second body and a second portion extending into said gap wherein said second portion of said first seal and said second portion of said second seal are parallel and overlapping with each other to seal said gap, wherein a third seal is disposed within said second body adjacent said second seal, wherein the first seal is a ring seal and the second seal is a featherseal.

27. The sealing system of claim 26, wherein the first seal and second seal are in physical communication.

28. The sealing system of claim 26, wherein the featherseal includes an angle of about 90° degrees.

29. A sealing system for sealing a gap between a first body and a second body comprising:

a first seal having a first portion adapted to be attached to said first body and a second portion extending across said gap and a second seal having a first portion adapted to be attached to said second body and a second portion extending across said gap wherein said second portion of said first seal and said second portion of said second seal are adjacent and overlapping with each other to seal said gap, wherein said second seal includes a horizontal section, and a vertical section extending from said horizontal section, said horizontal section and said vertical section enclosed in said second body, wherein said first seal is disposed at an angle relative to said second seal, wherein said first seal includes a first end contacting said second seal and a second end is disposed in a slot defined in the first body, wherein the first seal and second seal are held in a fixed position by gas pressure.

30. A sealing system or sealing a gap between a first body and a second body comprising:

a first seal having a first portion adapted to be attached to said first body and a second portion extending across said gap and a second seal having a first portion adapted to be attached to said second body and a second portion extending across said gap wherein said second portion of said first seal and said second portion of said second seal are adjacent and overlapping with each other to seal said gap, wherein said second seal includes a horizontal section, and a vertical section extending from said horizontal section, said horizontal section and said vertical section enclosed in said second body, wherein said first body includes a slot, wherein said first seal extends into said slot, wherein a position where said second portion of said first seal and said second portion of said second seal are adjacent and overlapping is at least partially enclosed in said slot.

* * * * *

UNITED STATES PATENT AND TRADEMARK OFFICE

CERTIFICATE OF CORRECTION

PATENT NO. : 8,794,640 B2
APPLICATION NO. : 12/731285
DATED : August 5, 2014
INVENTOR(S) : Russell J. Bergman It is certified that error appears in the above-identified patent and that said Letters Patent is hereby corrected as shown below:

IN THE CLAIMS:

In claim 15, column 5, line 43; replace *as* with --gas--

Signed and Sealed this
Eleventh Day of November, 2014

Michelle K. Lee

Michelle K. Lee
*Deputy Director of the United States Patent and Trademark Office*